US011749108B2

(12) United States Patent
Al-Nadawi et al.

(10) Patent No.: US 11,749,108 B2
(45) Date of Patent: Sep. 5, 2023

(54) SYSTEM AND METHOD FOR LANE LEVEL TRAFFIC STATE ESTIMATION

(71) Applicant: Honda Motor Co., Ltd., Tokyo (JP)

(72) Inventors: Yasir Khudhair Al-Nadawi, Ann Arbor, MI (US); Hossein Nourkhiz Mahjoub, Ann Arbor, MI (US); Laith Daman, Novi, MI (US)

(73) Assignee: HONDA MOTOR CO., LTD., Tokyo (JP)

( * ) Notice: Subject to any disclaimer, the term of this patent is extended or adjusted under 35 U.S.C. 154(b) by 197 days.

(21) Appl. No.: 17/218,691

(22) Filed: Mar. 31, 2021

(65) Prior Publication Data

US 2022/0319309 A1 Oct. 6, 2022

(51) Int. Cl.
*G08G 1/01* (2006.01)

(52) U.S. Cl.
CPC ..... *G08G 1/0133* (2013.01); *G08G 1/0112* (2013.01); *G08G 1/0141* (2013.01)

(58) Field of Classification Search
CPC ... G08G 1/0133; G08G 1/0112; G08G 1/0141
USPC ..... 340/934
See application file for complete search history.

(56) References Cited

U.S. PATENT DOCUMENTS 8,688,321 B2 4/2014 Prakah-Asante et al.
8,781,707 B2 * 7/2014 Kagawa ..... G08G 1/0133 340/936
8,798,841 B1 8/2014 Nickolaou et al.
8,930,115 B2 1/2015 Filev et al.
9,117,098 B2 * 8/2015 Trombley ..... G06G 1/00
9,352,683 B2 5/2016 Ignaczak et al.
9,406,229 B2 8/2016 Basnayake et al.
9,443,424 B2 9/2016 Koshizen
(Continued)

FOREIGN PATENT DOCUMENTS

CN 106781509 B 5/2017
CN 107205046 B 9/2017
(Continued)

OTHER PUBLICATIONS

Messmer, A., Papageorgiou, M., "METANET: a macroscopic simulation program for motorway networks." Traffic Engineering and Control, 31:466-470, Jan. 1990.

*Primary Examiner* — Kerri L McNally
*Assistant Examiner* — Thang D Tran
(74) *Attorney, Agent, or Firm* — RANKIN, HILL & CLARK LLP

(57) ABSTRACT

A method for traffic state estimation of a road network based on a plurality of vehicles including probe vehicles and non-probe vehicles travelling includes receiving probe vehicle data from the probe vehicles within a communication range of a host vehicle. The method also includes spatially and temporally associating the probe vehicle data to lane level cells of the road network, and identifying empty lane level cells of the road network where the probe vehicle data is unavailable. The method includes calculating estimated non-probe vehicle data for the empty lane level cells based on the probe vehicle data. The method further includes calculating a traffic density value for the road network based on the probe vehicle data and the estimated non-probe vehicle data and providing the traffic density value to the host vehicle.

20 Claims, 7 Drawing Sheets

(56) References Cited

U.S. PATENT DOCUMENTS 9,672,734 B1* 6/2017 Ratnasingam ..... H04W 4/44
10,147,317 B2* 12/2018 Hirata ..... G08G 1/096
2007/0100537 A1* 5/2007 Parikh ..... G08G 1/20 701/117
2007/0112503 A1* 5/2007 Johnson ..... G08G 1/0104 701/469
2007/0213922 A1* 9/2007 Van Buer ..... H04W 4/44 701/117
2012/0173530 A1* 7/2012 Kurciska ..... G06F 16/29 707/738
2012/0239253 A1 9/2012 Schmidt et al.
2014/0114545 A1* 4/2014 Groger ..... B60W 10/06 701/99
2016/0210852 A1* 7/2016 Buchholz ..... G08G 1/0129
2017/0076594 A1* 3/2017 Scofield ..... G01C 21/3469
2017/0309171 A1* 10/2017 Zhao ..... G08G 1/096827
2019/0103019 A1* 4/2019 Fowe ..... G08G 1/015
2019/0204108 A1* 7/2019 Benincasa ..... G08G 1/167
2019/0329770 A1* 10/2019 Rajab ..... G08G 1/163
2019/0375408 A1* 12/2019 Ruenz ..... B60W 30/18
2020/0066151 A1 2/2020 Morales Bolaños et al.
2020/0104880 A1* 4/2020 Shafai ..... G06Q 30/0266
2020/0135015 A1* 4/2020 Kalabic ..... G08G 1/0133
2020/0298840 A1* 9/2020 Shimotani ..... G08G 1/0112
2020/0386569 A1* 12/2020 Stajner ..... G01C 21/3841
2021/0157307 A1* 5/2021 Fowe ..... G06Q 10/06395
2021/0269026 A1* 9/2021 van Lier ..... B60W 30/02
2021/0302960 A1* 9/2021 McGill, Jr. ..... G08G 1/096708
2022/0170761 A1* 6/2022 Mubarek ..... G01C 21/30

FOREIGN PATENT DOCUMENTS

CN 110310480 A 10/2019
CN 110364008 A 10/2019

* cited by examiner

Observer Block Diagram

SYSTEM AND METHOD FOR LANE LEVEL TRAFFIC STATE ESTIMATION

BACKGROUND

Traffic monitoring systems typically include infrastructure positioned near a roadway that monitors the number of vehicles passing a predefined portion of roadway. An indication of the level of traffic on the roadway is then transmitted to vehicles and/or personal devices that are interested in that traffic information. For roadways that include multiple lanes, the traffic level information is typically not lane-level information, but rather, is an indication of the level of traffic on all of the lanes. Other lane speed monitoring techniques that do not rely on infrastructure positioned near the roadway may use an average velocity from a range of vehicle-to-vehicle (V2V) equipped vehicles to determine traffic congestion levels. However, an average velocity measured using only data from the V2V equipped vehicles is not indicative of the level of traffic congestion in all situations. In particular, lane speed monitoring does not provide compensation for the lack of measurements in road segments with no V2V equipped vehicles and/or in road segments where vehicle data is not available. Relying on only a portion of the traffic agents (i.e., V2V equipped vehicles) impacts the accuracy of lane speed monitoring, especially for low penetration rate scenarios. More intuitive metrics quantifying traffic congestion are needed.

BRIEF DESCRIPTION

According to one aspect, a computer-implemented method for traffic state estimation of a road network is based on a plurality of vehicles including probe vehicles and non-probe vehicles. The probe vehicles and the non-probe vehicles are travelling on the road network. The method includes receiving probe vehicle data from the probe vehicles of the plurality of vehicles within a communication range of the host vehicle. The method also includes spatially associating the probe vehicle data to lane level cells of the road network. The method also includes identifying empty lane level cells of the road network where the probe vehicle data is unavailable. The method further includes calculating estimated non-probe vehicle data for the empty lane level cells based on the probe vehicle data. The method includes calculating a traffic density value for the road network based on the probe vehicle data and the estimated non-probe vehicle data, and providing the traffic density value to the host vehicle.

According to another aspect, a system for traffic state estimation of a road network includes a host vehicle travelling along the road network equipped for computer communication, and a plurality of vehicles travelling along the road network. The plurality of vehicles include probe vehicles and non-probe vehicles, where the probe vehicles are equipped for computer communication. The system also includes a processor operatively connected for computer communication to the host vehicle and the probe vehicles. The processor receives probe vehicle data from the probe vehicles and spatially associates the probe vehicle data at a lane level of the road network. The processor also identifies empty lane level cells of the road network where probe vehicle data is unavailable, and calculates estimated non-probe vehicle data for the empty lane level cells based on the probe vehicle data. Further, the processor calculates a traffic density value for the road network based on the probe vehicle data and the estimated non-probe vehicle data. The processor provides the traffic density value to the host vehicle.

According to a further aspect, a non-transitory computer-readable storage medium includes instructions that when executed by a processor causes the processor to receive probe vehicle data from probe vehicles of a plurality of vehicles within a communication range of a host vehicle travelling along a road network. The medium also causes the processor to spatially associate the probe vehicle data to lane level cells of the road network. The medium further causes the processor to identify empty lane level cells of the road network having an empty value. The medium causes the processor to calculate estimated non-probe vehicle data for the empty lane level cells based on the probe vehicle data. Additionally, the medium causes the processor to calculate a traffic density value for the road network based on the probe vehicle data and the estimated non-probe vehicle data. The medium also causes the processor to transmit the traffic density value to the host vehicle.

BRIEF DESCRIPTION OF THE DRAWINGS

The accompanying drawings, which are incorporated in and constitute a part of the specification, illustrate various systems, methods, devices, and other embodiments of the disclosure. It will be appreciated that the illustrated element boundaries (e.g., boxes, groups of boxes, directional lines, or other shapes) in the figures represent one embodiment of the boundaries. In some embodiments one element may be designed as multiple elements or that multiple elements may be designed as one element. In some embodiments, an element shown as an internal component of another element may be implemented as an external component and vice versa. Furthermore, elements may not be drawn to scale.

DETAILED DESCRIPTION

Figure 1A:
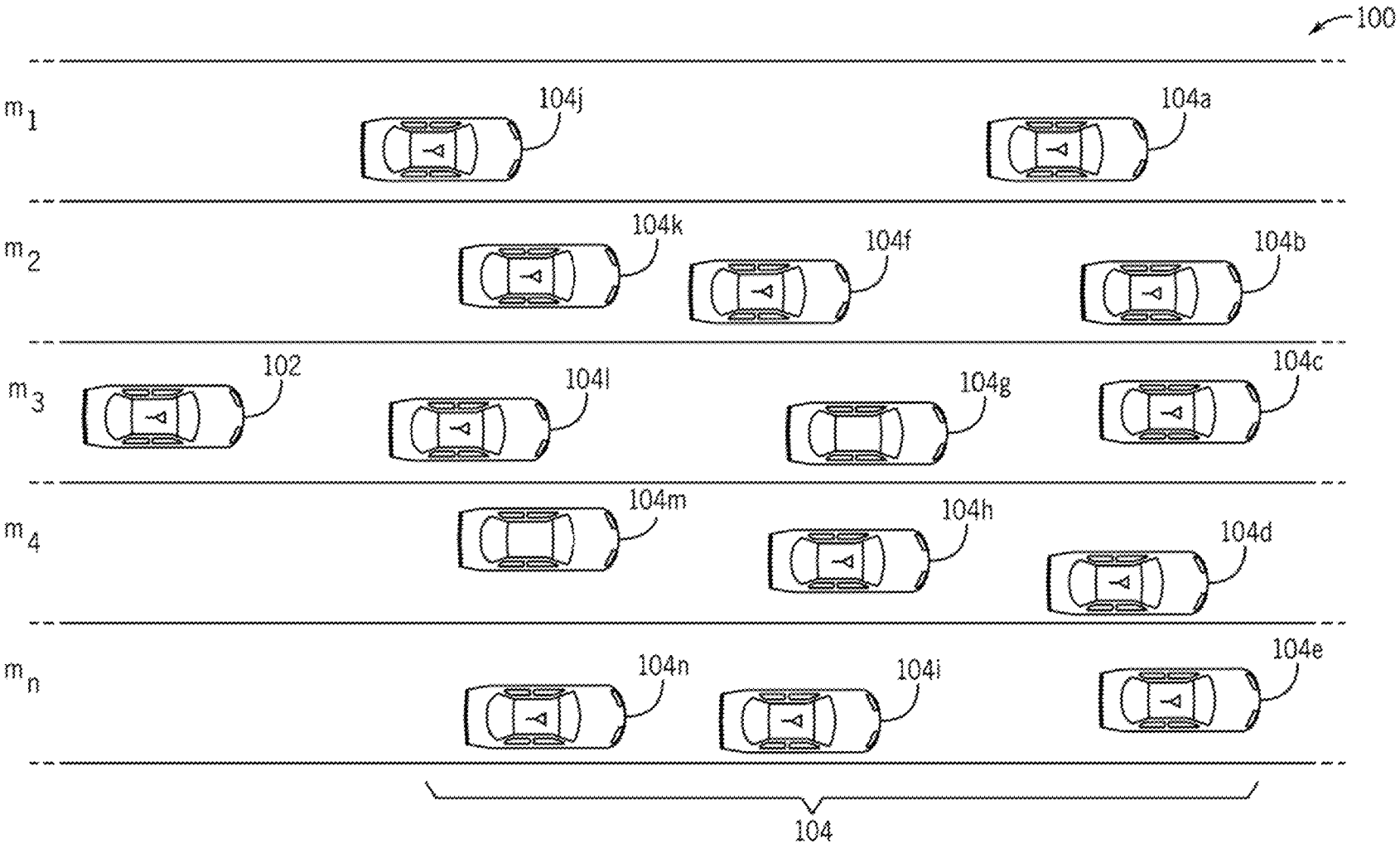
FIG. 1A is a schematic view of a road network according to an exemplary embodiment.

The following includes definitions of selected terms employed herein. The definitions include various examples and/or forms of components that fall within the scope of a term and that may be used for implementation. The examples are not intended to be limiting. Further, the components discussed herein, may be combined, omitted or organized with other components or into different architectures.

"Bus," as used herein, refers to an interconnected architecture that is operably connected to other computer components inside a computer or between computers. The bus may transfer data between the computer components. The bus may be a memory bus, a memory processor, a peripheral bus, an external bus, a crossbar switch, and/or a local bus, among others. The bus may also be a vehicle bus that interconnects components inside a vehicle using protocols such as Media Oriented Systems Transport (MOST), Controller Area network (CAN), Local Interconnect network (LIN), among others.

"Component," as used herein, refers to a computer-related entity (e.g., hardware, firmware, instructions in execution, combinations thereof). Computer components may include, for example, a process running on a processor, a processor, an object, an executable, a thread of execution, and a computer. A computer component(s) may reside within a process and/or thread. A computer component may be localized on one computer and/or may be distributed between multiple computers.

"Computer communication," as used herein, refers to a communication between two or more computing devices (e.g., computer, personal digital assistant, cellular telephone, network device, vehicle, vehicle computing device, infrastructure device, roadside device) and may be, for example, a network transfer, a data transfer, a file transfer, an applet transfer, an email, a hypertext transfer protocol (HTTP) transfer, and so on. A computer communication may occur across any type of wired or wireless system and/or network having any type of configuration, for example, a local area network (LAN), a personal area network (PAN), a wireless personal area network (WPAN), a wireless area network (WAN), a wide area network (WAN), a metropolitan area network (MAN), a virtual private network (VPN), a cellular network, a token ring network, a point-to-point network, an ad hoc network, a mobile ad hoc network, a vehicular ad hoc network (VANET), a vehicle-to-vehicle (V2V) network, a vehicle-to-everything (V2X) network, a vehicle-to-infrastructure (V2I) network, among others. Computer communication may utilize any type of wired, wireless, or network communication protocol including, but not limited to, Ethernet (e.g., IEEE 802.3), WiFi (e.g., IEEE 802.11), communications access for land mobiles (CALM), WiMax, Bluetooth, Zigbee, ultra-wideband (UWAB), multiple-input and multiple-output (MIMO), telecommunications and/or cellular network communication (e.g., SMS, MMS, 3G, 4G, LTE, 5G, GSM, CDMA, WAVE), satellite, dedicated short range communication (DSRC), among others.

"Computer-readable medium," as used herein, refers to a non-transitory medium that stores instructions and/or data. A computer-readable medium may take forms, including, but not limited to, non-volatile media, and volatile media. Non-volatile media may include, for example, optical disks, magnetic disks, and so on. Volatile media may include, for example, semiconductor memories, dynamic memory, and so on. Common forms of a computer-readable medium may include, but are not limited to, a floppy disk, a flexible disk, a hard disk, a magnetic tape, other magnetic medium, an ASIC, a CD, other optical medium, a RAM, a ROM, a memory chip or card, a memory stick, and other media from which a computer, a processor or other electronic device may read.

"Database," as used herein, is used to refer to a table. In other examples, "database" may be used to refer to a set of tables. In still other examples, "database" may refer to a set of data stores and methods for accessing and/or manipulating those data stores. A database may be stored, for example, at a disk and/or a memory.

"Disk," as used herein may be, for example, a magnetic disk drive, a solid-state disk drive, a floppy disk drive, a tape drive, a Zip drive, a flash memory card, and/or a memory stick. Furthermore, the disk may be a CD-ROM (compact disk ROM), a CD recordable drive (CD-R drive), a CD rewritable drive (CD-RW drive), and/or a digital video ROM drive (DVD ROM). The disk may store an operating system that controls or allocates resources of a computing device.

"Logic circuitry," as used herein, includes, but is not limited to, hardware, firmware, a non-transitory computer readable medium that stores instructions, instructions in execution on a machine, and/or to cause (e.g., execute) an action(s) from another logic circuitry, module, method and/or system. Logic circuitry may include and/or be a part of a processor controlled by an algorithm, a discrete logic (e.g., ASIC), an analog circuit, a digital circuit, a programmed logic device, a memory device containing instructions, and so on. Logic may include one or more gates, combinations of gates, or other circuit components. Where multiple logics are described, it may be possible to incorporate the multiple logics into one physical logic. Similarly, where a single logic is described, it may be possible to distribute that single logic between multiple physical logics.

"Memory," as used herein may include volatile memory and/or nonvolatile memory. Non-volatile memory may include, for example, ROM (read only memory), PROM (programmable read only memory), EPROM (erasable PROM), and EEPROM (electrically erasable PROM). Volatile memory may include, for example, RAM (random access memory), synchronous RAM (SRAM), dynamic RAM (DRAM), synchronous DRAM (SDRAM), double data rate SDRAM (DDRSDRAM), and direct RAM bus RAM (DRRAM). The memory may store an operating system that controls or allocates resources of a computing device.

"Operable connection," or a connection by which entities are "operably connected," is one in which signals, physical communications, and/or logical communications may be sent and/or received. An operable connection may include a wireless interface, a physical interface, a data interface, and/or an electrical interface.

"Portable device," as used herein, is a computing device typically having a display screen with user input (e.g., touch, keyboard) and a processor for computing. Portable devices include, but are not limited to, handheld devices, mobile devices, smart phones, laptops, tablets and e-readers.

"Processor," as used herein, processes signals and performs general computing and arithmetic functions. Signals processed by the processor may include digital signals, data signals, computer instructions, processor instructions, messages, a bit, a bit stream, that may be received, transmitted and/or detected. Generally, the processor may be a variety of various processors including multiple single and multicore processors and co-processors and other multiple single and multicore processor and co-processor architectures. The processor may include logic circuitry to execute actions and/or algorithms.

"Vehicle," as used herein, refers to any moving vehicle capable of carrying one or more human occupants and is powered by any form of energy. The term "vehicle" includes, but is not limited to cars, trucks, vans, minivans, SUVs, motorcycles, scooters, boats, go-karts, amusement ride cars, rail transport, personal watercraft, and aircraft. In some cases, a motor vehicle includes one or more engines. Further, the term "vehicle" may refer to an electric vehicle (EV) capable of carrying one or more human occupants and is powered entirely or partially by one or more electric motors powered by an electric battery. The EV may include battery electric vehicles (BEV) and plug-in hybrid electric vehicles (PHEV). The term "vehicle" may also refer to an autonomous vehicle and/or self-driving vehicle powered by any form of energy. The autonomous vehicle may carry one or more human occupants. The autonomous vehicle can have any level or mode of driving automation ranging from, for example, fully manual to fully autonomous. Further, the term "vehicle" may include vehicles that are automated or non-automated with pre-determined paths or free-moving vehicles.

"Vehicle control system," and/or "vehicle system," as used herein may include, but is not limited to, any automatic or manual systems that may be used to enhance the vehicle, driving, and/or security. Exemplary vehicle systems include, but are not limited to: an electronic stability control system, an anti-lock brake system, a brake assist system, an automatic brake prefill system, a low speed follow system, a cruise control system, a collision warning system, a collision mitigation braking system, an auto cruise control system, a lane departure warning system, a blind spot indicator system, a lane keep assist system, a navigation system, a transmission system, brake pedal systems, an electronic power steering system, visual devices (e.g., camera systems, proximity sensor systems), a climate control system, an electronic pre-tensioning system, a monitoring system, a passenger detection system, a vehicle suspension system, a vehicle seat configuration system, a vehicle cabin lighting system, an audio system, a sensory system, an interior or exterior camera system among others.

The methods and systems discussed herein determine traffic density ahead of a host vehicle by reconstructing measurements for segments of a road network where data is not available. For example, there may be vehicles ahead of the host vehicle that do not have communication capabilities (e.g., vehicle-to-vehicle (V2V), cellular) and therefore cannot be detected by the host vehicle and/or transmit data to the host vehicle. Thus, the methods and systems described herein use partial measurements of a group of traffic agents to reconstruct traffic density in all road segments including those road segments which have vehicles not capable of V2V communication. Referring now to the drawings, wherein the showings are for purposes of illustrating one or more exemplary embodiments and not for purposes of limiting same, FIG. 1A is a schematic view of an exemplary road network 100 according to one embodiment. The road network 100 can be any type of road, highway, and/or freeway. In FIG. 1A, the road network 100 includes five lanes, namely, a lane $m_1$, a lane $m_2$, a lane $m_3$, a lane $m_4$, and a lane $m_n$ each having the same travelling direction. It is understood that the road network 100 can have various configurations not shown in FIG. 1A, and can have any number of lanes.

In FIG. 1A, a host vehicle 102 is travelling along the road network 100 and is equipped for computer communication as indicated with an antenna symbol, which will be described in more detail herein with FIG. 2. Travelling in front of the host vehicle 102 are a plurality of vehicles 104 that include probe vehicles and non-probe vehicles. In the embodiments discussed herein, the plurality of vehicles 104 are longitudinally in front of (e.g., downstream) the host vehicle 102. However, it is understood that in some embodiments, one or more of the plurality of vehicles 104 can be behind, in front of, or otherwise positioned with respect to the host vehicle 102. The probe vehicles are vehicles equipped for computer communication as indicated with the antenna symbol. Specifically, in FIG. 1A, a vehicle 104*a*, a vehicle 104*b*, a vehicle 104*c*, a vehicle 104*d*, a vehicle 104*e*, a vehicle 104*f*, a vehicle 104*h*, a vehicle 104*i*, a vehicle 104*j*, a vehicle 104*k*, a vehicle 104*l*, and a vehicle 104*n* are probe vehicles. In contrast, the non-probe vehicles are vehicles not capable and/or equipped for computer communication. In FIG. 1A, the non-probe vehicles do not have an antenna symbol. More specifically, a vehicle 104*m* and a vehicle 104*g* are non-probe vehicles.

Figure 1B:
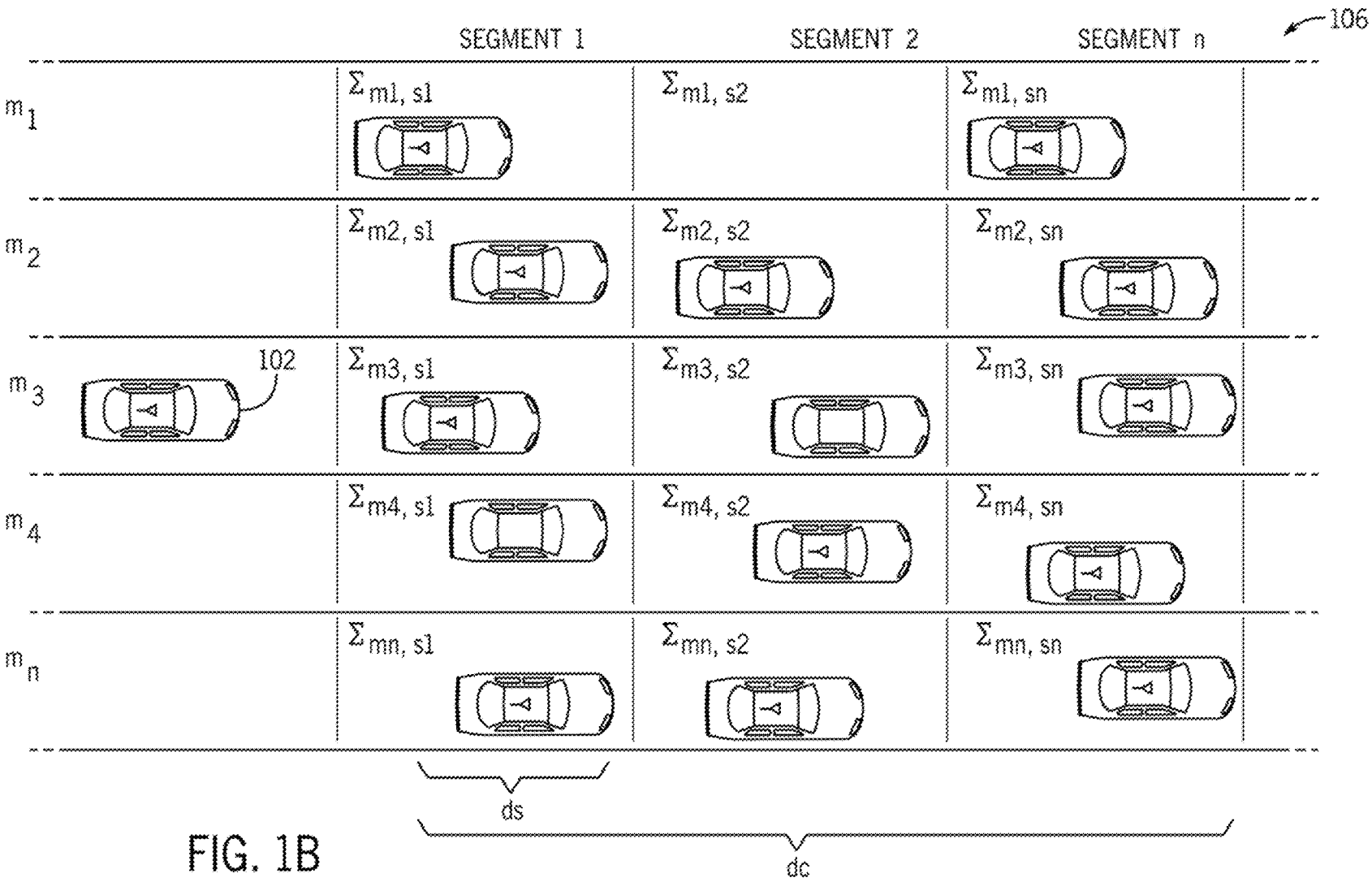
FIG. 1B is a schematic view of a grid model of the road network of FIG. 1A according to an exemplary embodiment.

As illustrated by FIG. 1A, the host vehicle 102 cannot detect and/or cannot communicate with the non-probe vehicles of the plurality of vehicles 104. Accordingly, vehicle data is not available for one or more road segments of the road network 100, as shown by a grid model 106 of FIG. 1B. In FIG. 1B, lane level cells m4S1 and m3S2 are not associated with vehicle data because the vehicle 104*m* and the vehicle 104*g* are non-probe vehicles. The systems and methods described herein compensate for this lack of data to provide lane level traffic state estimates.

Figure 2:
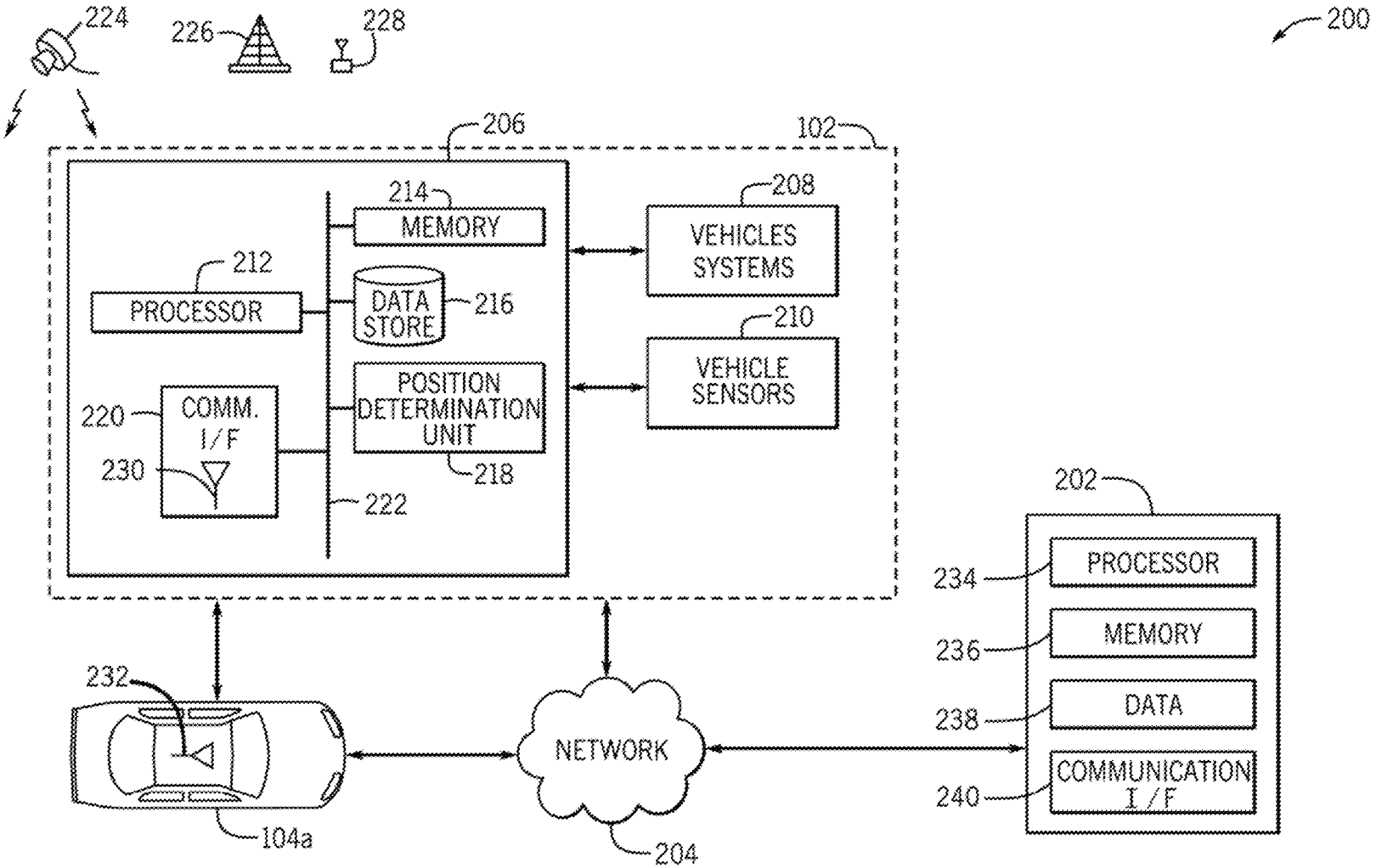
FIG. 2 is a block diagram of a system for lane level traffic state estimation according to one exemplary embodiment.

Referring now to FIG. 2, a schematic view of a system 200 for lane level traffic state estimation according to an exemplary embodiment is shown. One or more of the components of the system 200 can be considered in whole or in part a vehicle communication network. In FIG. 2, a block diagram of the host vehicle 102 is shown with a simplified block diagram of the vehicle 104*a*, a block diagram of a remote server 202, and a communication network 204. It is understood that the probe vehicles (i.e. the vehicle 104*a*, the vehicle 104*b*, the vehicle 104*c*, the vehicle 104*d*, the vehicle 104*e*, the vehicle 104*f*, the vehicle 104*h*, the vehicle 104*i*, the vehicle 104*j*, the vehicle 104*k*, the vehicle 104*l*, the vehicle 104*n*) and/or the remote server 202 can include one or more of the components and/or functions discussed herein with respect to the host vehicle 102. Further, it is understood that the non-probe vehicles (i.e., 104*g*, 104*m*) do not include components and/or functions for computer communication, however, the non-probe vehicles can include other components and/or functions discussed herein with respect to the host vehicle 102 Further, it is understood that the components of the host vehicle 102 and the system 200, as well as the components of other systems, hardware architectures, and software architectures discussed herein, can be combined, omitted, or organized into different architectures for various embodiments.

In FIG. 2, the host vehicle 102 includes a vehicle computing device (VCD) 206, vehicle systems 208, and vehicle sensors 210. Generally, the VCD 206 includes a processor 212, a memory 214, a data store 216, a position determination unit 218, and a communication interface (I/F) 220, which are each operably connected for computer communication via a bus 222 and/or other wired and wireless technologies defined herein. Referring again to the host vehicle 102, the VCD 206, can include provisions for processing, communicating and interacting with various components of the host vehicle 102 and other components of the system 200, including the vehicle 104*a* and the remote server 202. In one embodiment, the VCD 206 can be implemented with the host vehicle 102, for example, as part of a telematics unit, a head unit, an infotainment unit, an electronic control unit, an on-board unit, or as part of a specific vehicle control system, among others. In other embodiments, the VCD 206 can be implemented remotely from the host vehicle 102, for example, with a portable device (not shown), a remote device (not shown), or the remote server 202, connected via the communication network 204.

The processor 212 can include logic circuitry with hardware, firmware, and software architecture frameworks for facilitating lane level traffic estimation and control of the host vehicle 102 and/or the vehicle 104*a*. Thus, in some embodiments, the processor 212 can store application frameworks, kernels, libraries, drivers, application program interfaces, among others, to execute and control hardware and functions discussed herein. In some embodiments, the memory 214 and/or the data store (e.g., disk) 216 can store similar components as the processor 212 for execution by the processor 212.

The position determination unit 218 can include hardware (e.g., sensors) and software to determine and/or acquire position data about the host vehicle 102. For example, the position determination unit 218 can include a global positioning system (GPS) unit (not shown) and/or an inertial measurement unit (IMU) (not shown). Thus, the position determination unit 218 can provide a geoposition of the host vehicle 102 based on satellite data from, for example, a global position source 224, or from any Global Navigational Satellite infrastructure (GNSS), including GPS, Glonass (Russian) and/or Galileo (European). Further, the position determination unit 218 can provide dead-reckoning data or motion data from, for example, a gyroscope, accelerometer, magnetometers, among other sensors (not shown). In some embodiments, the position determination unit 218 can be a navigation system that provides navigation control and navigation information to the host vehicle 102.

The communication interface 220 can include software and hardware to facilitate data input and output between the components of the host vehicle 102 and other components of the system 200. Specifically, the communication interface 220 can include network interface controllers (not shown) and other hardware and software that manages and/or monitors connections and controls bi-directional data transfer between the communication interface 220 and other components of the system 200 using, for example, the communication network 204.

More specifically, in one embodiment, the VCD 206 can exchange data and/or transmit messages with other compatible vehicles and/or devices via a transceiver 230 or other communication hardware and protocols. For example, the transceiver 230 can exchange data with the vehicle 104*a* via a transceiver 232. In some embodiments, the host vehicle 102 and the vehicle 104*a* can exchange data (e.g., vehicle data, probe vehicle data, non-probe vehicle data as described herein) utilizing a wireless network antenna 226, roadside equipment (RSE) 228, and/or the communication network 204 (e.g., a wireless communication network), or other wireless network connections.

As mentioned above, in some embodiments, data transmission can be executed at and/or with other infrastructures and servers. For example, in FIG. 2, the VCD 206 can transmit and receive information directly or indirectly to and from the remote server 202 over the communication network 204. The remote server 202 can include a remote processor 234, a remote memory 236, a remote data store 238, and a remote communication interface 240 that are configured to be in communication with one another. Thus, in FIG. 2, the transceiver 230 can be used by the VCD 206 to receive and transmit information to and from the remote server 202 and other servers, processors, and information providers through the communication network 204. In some embodiments, the VCD 206 can receive and transmit information to and from the remote server 202 including, but not limited to, vehicle data, probe vehicle data, traffic data, road data, curb data, vehicle location and heading data, high-traffic event schedules, weather data, or other transport related data. In some embodiments, the remote server 202 can be linked to multiple vehicles (e.g., the vehicle 104*a*), other entities, traffic infrastructures, and/or devices through a network connection, such as via the wireless network antenna 226, the road side equipment 228, and/or other network connections.

Referring again to the host vehicle 102, the vehicle systems 208 can include any type of vehicle control system and/or vehicle system described herein to enhance the host vehicle 102 and/or driving of the host vehicle 102. For example, the vehicle systems 208 can include autonomous driving systems, driver-assist systems, adaptive cruise control systems, lane departure warning systems, merge assist systems, freeway merging, exiting, and lane-change systems, collision warning systems, integrated vehicle-based safety systems, and automatic guided vehicle systems, or any other advanced driving assistance systems (ADAS). As will be described in more, one or more of the vehicle systems 208 can be controlled according to the systems and methods discussed herein.

The vehicle sensors 210, which can be implemented with the vehicle systems 208, can include various types of sensors for use with the host vehicle 102 and/or the vehicle systems 208 for detecting and/or sensing a parameter of the host vehicle 102, the vehicle systems 208, and/or the environment surrounding the host vehicle 102. For example, the vehicle sensors 210 can provide data about other vehicles in proximity to the host vehicle 102. The vehicle sensors 210 can include, but are not limited to: acceleration sensors, speed sensors, braking sensors, proximity sensors, vision sensors, ranging sensors, seat sensors, seat-belt sensors, door sensors, environmental sensors, yaw rate sensors, steering sensors, GPS sensors, among others. It is also understood that the vehicle sensors 210 can be any type of sensor, for example, acoustic, electric, environmental, optical, imaging, light, pressure, force, thermal, temperature, proximity, among others.

Using the system and network configuration discussed above, lane level traffic state estimation and vehicle control can be provided for each lane level cell including those lane level cells that do not have a value (e.g., lane level cells occupied by a non-probe vehicle). Detailed embodiments describing exemplary methods using the system and network configuration discussed above will now be discussed in detail.

Figure 3:
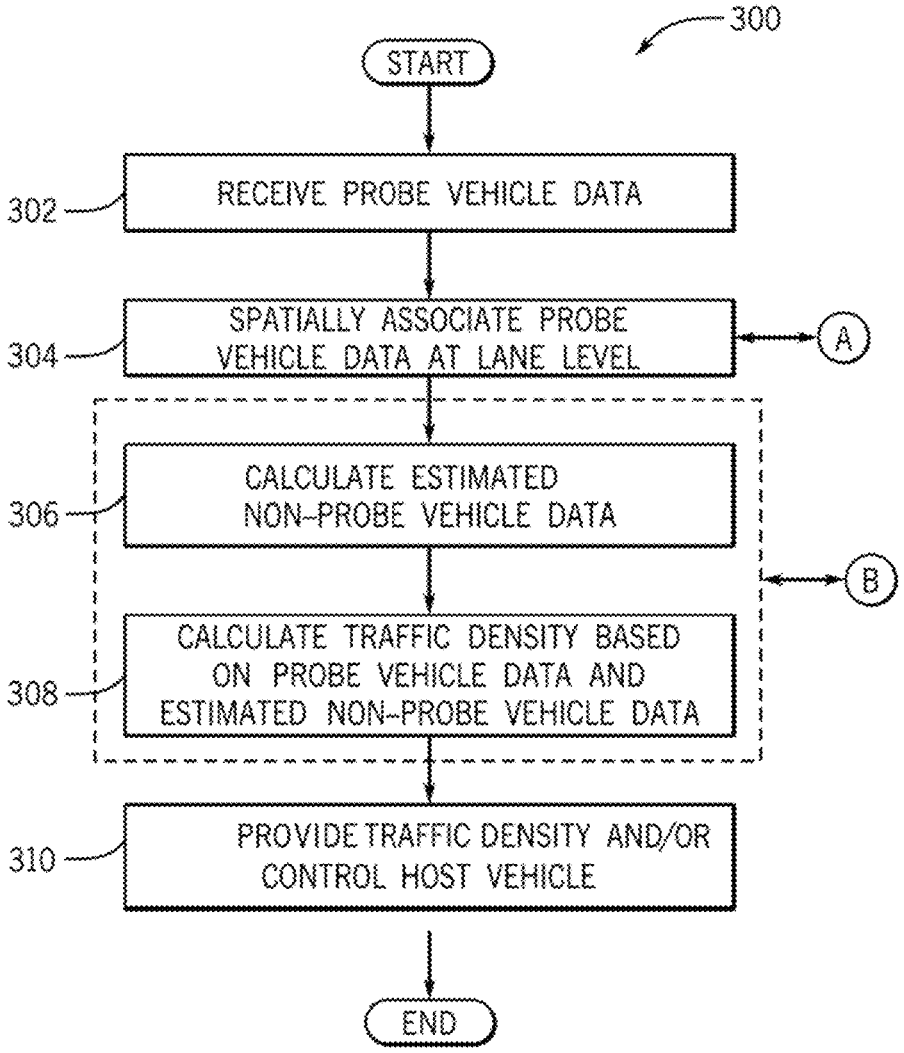
FIG. 3 is a process flow diagram of a method for lane level traffic state estimation according to one exemplary embodiment.
Figure 4:
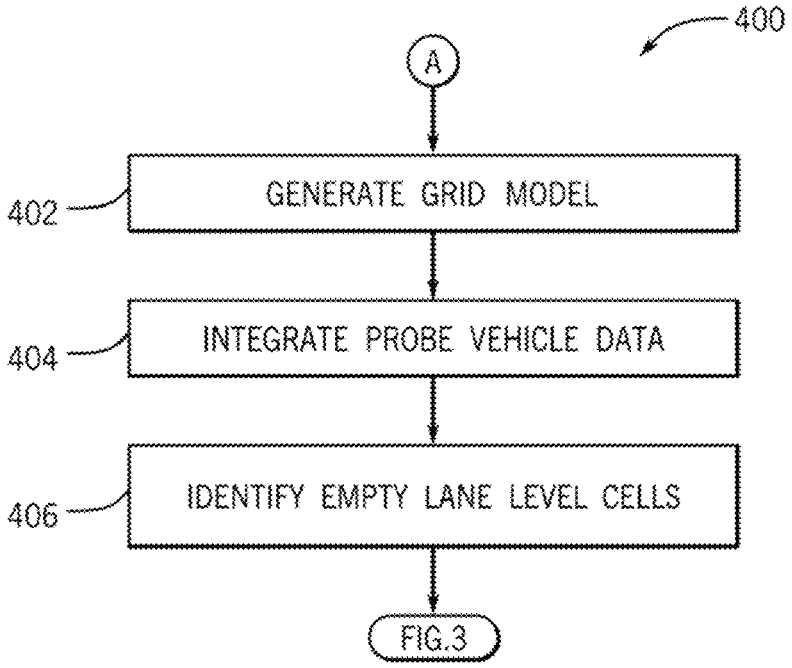
FIG. 4 is a process flow diagram of a method for identifying empty lane level cells according to one exemplary embodiment.

Referring now to FIG. 3, a method 300 for lane level traffic state estimation according to one embodiment is shown. FIG. 3 will be described with reference to the components of FIGS. 1A, 1B, and 2. It is understood that the methods described herein (e.g., FIGS. 4-5) are performed at each time step. Therefore, the discretization is done not only spatially, but also temporally. At block 302, the method 300 includes receiving probe vehicle data. More specifically, the probe vehicle data is received by the processor 212 from the probe vehicles of the plurality of vehicles 104, namely, the vehicle 104*a*, the vehicle 104*b*, the vehicle 104*c*, the vehicle 104*d*, the vehicle 104*e*, the vehicle 104*f*, the vehicle 104*h*, the vehicle 104*i*, the vehicle 104*j*, the vehicle 104*k*, the vehicle 104*l*, and the vehicle 104*n*. The probe vehicles are equipped for computer communication as defined herein and are within a communication range of the host vehicle 102. The communication range can be based on the communication protocol used for V2V communication. As an illustrative example, DSRC communication can have a communication range of 300 m.

Probe vehicle data, as used herein, can include any vehicle data about the probe vehicle and/or vehicle control systems of the probe vehicle. For example, the probe vehicle data can include vehicle dynamics data and vehicle positioning data included with a Basic Safety Message transmitted from the probe vehicle to the host vehicle 102. As an illustrative example, probe vehicle data can include speed, acceleration, velocity, yaw rate, steering angle, and throttle angle, range or distance data, course heading data, course history data, projected course data, kinematic data, current vehicle position data, and any other vehicle information about the probe vehicle and the environment surrounding the probe vehicle.

Referring again to the method 300, block 304 includes spatially associating probe vehicle data at lane level. In one embodiment, the processor 212 spatially and temporally associates the probe vehicle data to lane level cells of the road network 100. This embodiment will now be described in more detail with FIG. 4 and FIG. 1B. At block 402, the method 400 includes generating a grid model. The grid model is partitioned at a cell level. For example, the processor 212 can generate the grid model 106 schematically shown in FIG. 1B. The grid model 106 represents the road network 100 including the plurality of lanes $m_1 \ldots m_n$. Each lane in the plurality of lanes includes a plurality of lane level cells where each of the lane level cells includes a particular segment of each lane in the plurality of lanes. Since spatial and temporal associations are applied, the grid model 106 "moves" with the host vehicle 102.

More specifically and with reference to FIG. 1B, a range of interest dc (e.g., a communication range) with respect to the host vehicle 102 center position is divided into n segments. Each segment has a length of ds and each segment is partitioned into m cells, where m is the number of lanes. Accordingly, in FIG. 1B, each lane level cell is referenced by a lane and a segment. Thus, the grid model 106 and data integration can be based on a nonlinear model including spatial discretization and time discretization. For example, the METANET model can be implemented, however, it is understood that other types of modeling can also be used.

At block 404, the method 400 includes integrating the probe vehicle data. More specifically, the processor 212 integrates the probe vehicle data to a corresponding lane level cell of the plurality of lane level cells. Thus, the probe vehicle data is integrated by classifying each probe vehicle by its location and other probe vehicle data. Referring again to the grid model 106, the probe vehicle data is partitioned (e.g., integrated) into the lane level cells (e.g., longitudinally) and into time slices. In one embodiment, time is discretized based on sampling time interval $T_s$ and integer time index k. The main assumption is the availability of mean speed and flow for each segment $\Sigma_{ms}$. Although not shown in FIG. 1B, the grid model 106 can also consider flow for each lane level cell that has occurred due to lane changes between adjacent cells. Also, each segment could have at least one on-ramp flow and/or off-ramp flow and the grid model 106 can also consider these types of ramp flows.

At block 406, the method 400 includes identifying the empty lane level cells. More specifically, the processor 212 evaluates each lane level cell to identify and/or determine the lane level cells of the plurality of lane level cells having an empty value. An empty value indicates that probe vehicle data is unavailable and/or was not received with respect to a particular segment of the road network 100. As an illustrative example with the plurality of vehicles 104 shown in FIGS. 1A and 1B, the non-probe vehicles (i.e., the vehicle 104*g*, the vehicle $\mathbf{104}_m$) are not capable of providing vehicle data. Thus, the segments of the road network 100 where the non-probe vehicles are located will be empty and/or have no value. More specifically, the lane level cell $m_3s_2$ corresponding to the location of the vehicle 104*g* and the lane level cell $m_4,s_1$ corresponding to the location of the vehicle 104*m* are empty and/or have no value. Accordingly, for each lane level cell that is empty and/or has no value, the processor 212 identifies said lane level cell as empty since no probe vehicle data is available.

In other embodiments, a lane level cell is deemed to be empty based on whether probe vehicle data was received from at least one vehicle detected in the lane level cell. For example, although a probe vehicle is located in a lane level cell, there could be errors with transmitting the probe vehicle data and/or the probe vehicle data could be corrupted. In these situations, the processor 212 can identify said lane level cell as empty. In another embodiment, an empty cell is defined as a cell with no vehicles (e.g., probe and/or non-probe vehicles). For example, in FIG. 1B, the lane level cell $m_1,s_2$ is an empty cell because it does not include a probe vehicle and/or a non-probe vehicle. The empty state of the lane level cell $m_1,s_2$ can change at a different time steps based on the lane level cells behind (i.e., the lane level cell $m_1, s_1$) and in front (i.e., the lane level cell $m_1, s_n$) of the lane level cell $m_1,s_2$.

Referring again to FIG. 3, at block 306, the method 300 includes calculating estimated non-probe vehicle data. The processor 212 calculates estimated non-probe vehicle data for each empty lane level cell based on the probe vehicle data. In one embodiment that will be discussed in more detail herein, the estimated non-probe vehicle data is based on probe data from adjacent cells. At block 308, the method 300 includes calculating traffic density based on probe vehicle data and non-probe vehicle data. Blocks 306 and 308 will now be discussed in more detail with FIG. 5.

A method 500 for calculating traffic density includes, at block 502, calculating a traffic flow value and an average speed value for each lane level cell based on the probe vehicle data. Said differently, for each non-empty lane level cell, the processor 212 calculates an average speed (v) and a traffic flow value (q, throughput) using the probe data corresponding to the lane level cell.

At block 504, the method 500 includes calculating the estimated non-probe vehicle data for the empty lane level cells based on the probe vehicle data. Here, the processor 212 calculates an estimated average speed and an estimated traffic flow value for each lane level cell that has no value and/or has been identified as an empty lane level cell (see FIG. 4, block 406). In one embodiment, the processor 212 calculates the estimated non-probe vehicle data for the empty lane level cells based on the probe vehicle data from adjacent lane level cells of the road network 100. An adjacent lane level cell is a lane level cell that is next to or adjoining the empty lane level cell and is not empty itself. For example, an adjacent lane level cell can be an adjoining cell in front, behind, to the left, and/or to the right of the empty lane level cell. With reference to the grid model 106 of FIG. 1B, the lane level cell m2,s2 is an empty cell. Adjacent cells include the lane level cell m2,s1, the lane level cell m3*s*2, the lane level cell m2,*sn*, and the lane level cell m1,s2. However, the lane level cell m1*s*2 is an empty cell. Accordingly, the processor 212 calculates the estimated non-probe vehicle data based on the probe vehicle data associated with the lane level cell m2,s1, the lane level cell m3*s*2, and the lane level cell m2,*sn*.

Figure 1C:
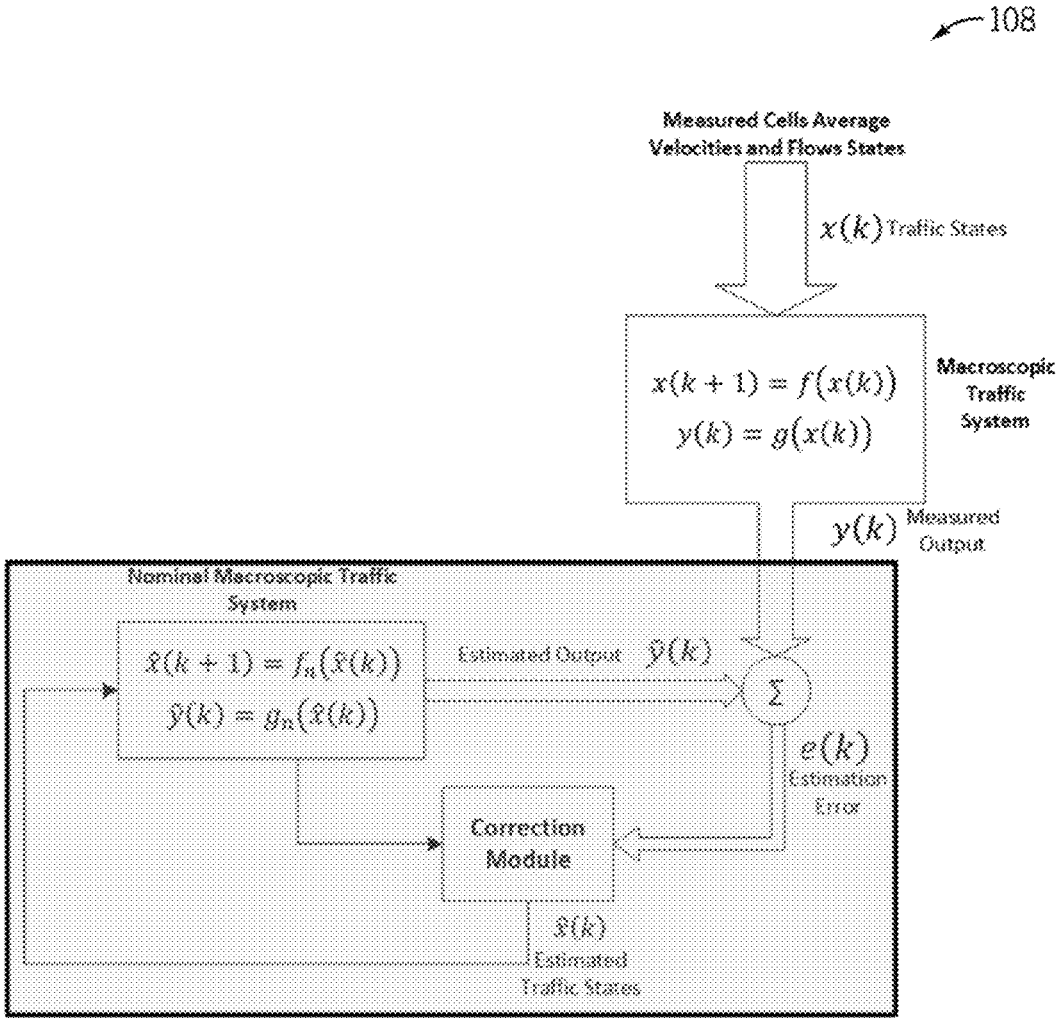
FIG. 1C is a block diagram of an observer model according to an exemplary embodiment.

In one embodiment, calculating the estimated non-probe vehicle data for the empty lane level cells based on the probe vehicle data as discussed above is facilitated by an observer model (e.g., a Kalman filter). FIG. 1C illustrates an exemplary observer model 108. The observer model 108 is a system where the traffic states x(k) from the measured cell averages and flow states are fed forward for estimation modeling. The correction module corrects and/or estimates any deviations related to parameter perturbations or external disturbance inputs (e.g., empty lane level cells).

Figure 5:
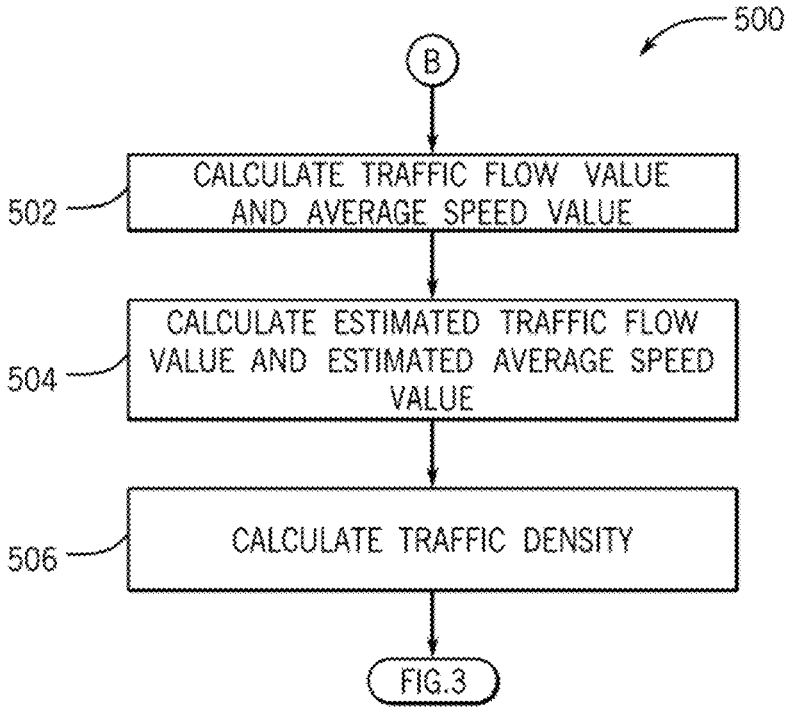
FIG. 5 is a process flow diagram of a method for calculating traffic density according to one exemplary embodiment.

Referring again FIG. 5, block 506 includes calculating the traffic density value for the road network 100 to block 506, based on the probe vehicle data including the average speed value and the traffic flow value, and the estimated non-probe vehicle data including the estimated traffic flow value and the estimated average speed value. Calculating the traffic density in this way ensures that each lane level cell is considered even though data with some lane level cells is unavailable. Thus, in one embodiment, the traffic density value of an empty lane level cell is estimated by using the average speed value and the traffic flow value of lane level cells adjacent to the empty lane level cell.

The traffic density value quantifies traffic measures from the perspective of the host vehicle 102. For example, the traffic density value can be a traffic level status (e.g., free-flow, light, medium, congested, heavily congested) for each segment of each lane ahead of the host vehicle 102 within a range of interest (e.g., the communication range). It is understood that the traffic density value can be any numerical or other kind of value for distinguishing between traffic states. It is further understood that multiple traffic density values can be calculated, for example, for each segment of each lane ahead of the host vehicle 102.

Referring again to FIG. 3, at block 310, the method 300 includes providing the traffic density value to the host vehicle 102 and/or controlling the host vehicle 102 based on the traffic density value. For example, the processor 212 can transmit the traffic density value to the host vehicle 102. The processor 212 can also control the host vehicle 102 based on the traffic density value. In one embodiment, controlling the host vehicle 102 includes modifying movement of the host vehicle 102 based on the traffic density value. This can include modifying one or more of the vehicle systems 108, for example, an ADAS system (e.g., an automatic cruise control system, a lane keep assist system) or another vehicle control system. In one embodiment, the processor 212 generates a control signal based on the traffic density value and transmits the control signal to the vehicle systems 108 and/or executes the control signal at the vehicle systems 108. The control and/or modification of the host vehicle 102 can be used to help reduce traffic density values and/or traffic congestion. Illustrative examples of vehicle control will now be described in more detail.

For example, the control executed at block 310 can be within the context of a swarm. Multiple vehicles, having some level of autonomy and operating in a coordinated manner, are referred to as a swarm. The vehicles operating in the coordinated manner are members of the swarm. In one embodiment, the host vehicle 102, one or more of the plurality of vehicles 104, and/or one or more other vehicles (not shown) are members of the swarm. The host vehicle 102 could be a leader of the swarm and the collective behavior of the swarm can be controlled based on the traffic density value. In this example, a control signal is generated based on the traffic density value to control movement of one or more member vehicles. The control signal can be transmitted by the processor 212 to the one or more member vehicles to collectively control the behavior of the swarm. In one embodiment, the movement of the member vehicles and/or a destination of the member vehicles can be modified to avoid a slow traffic area or alleviate a slow traffic area. In another embodiment, members of a swarm can be selected based on the traffic density value to navigate through a slow traffic area in a more efficient way.

The control at block 310 can also be in the context of traffic notifications, suggestions, and warnings. For example, the processor 212 can provide an alert signal or a graphic representation based on the traffic density value to alert a vehicle occupant of the host vehicle 102 and/or other vehicles on the road network 100. Thus, the processor 212 can provide the traffic density value to the host vehicle 102 and the host vehicle 102 can control one or more vehicle systems 208 (e.g., HMI) to display an indication of the traffic density value in the host vehicle 102. In other embodiments, the traffic density value can be transmitted to third parties and or broadcasted to other entities via the communication network 204. It is understood that the methods and systems described herein can be implemented with other use case scenarios.

The embodiments discussed herein can also be described and implemented in the context of "computer-readable medium" or "computer storage medium." As used herein, "computer-readable medium" or "computer storage medium refers to a non-transitory medium that stores instructions, algorithms, and/or data configured to perform one or more of the disclosed functions when executed. Computer-readable medium can be non-volatile, volatile, removable, and non-removable, media implemented in any method or technology for storage of information such as computer readable instructions, data structures, modules or other data. Computer-readable medium can include, but is not limited to, a floppy disk, a flexible disk, a hard disk, a magnetic tape, other magnetic medium, an application specific integrated circuit (ASIC), a programmable logic device, a compact disk (CD), other optical medium, a random access memory (RAM), a read only memory (ROM), a memory chip or card, a memory stick, solid state storage device (SSD), flash drive, and other media from which a computer, a processor or other electronic device can interface with. Computer-readable medium excludes non-transitory tangible media and propagated data signals.

It will be appreciated that various embodiments of the above-disclosed and other features and functions, or alternatives or varieties thereof, may be desirably combined into many other different systems or applications. Also, that various presently unforeseen or unanticipated alternatives, modifications, variations or improvements therein may be subsequently made by those skilled in the art which are also intended to be encompassed by the following claims.

The invention claimed is:

1. A computer-implemented method for traffic state estimation of a road network based on a plurality of vehicles including probe vehicles and non-probe vehicles travelling on the road network, comprising:

receiving probe vehicle data from the probe vehicles of the plurality of vehicles within a communication range of a host vehicle, wherein the probe vehicles are equipped for computer communication with other probe vehicles;

spatially and temporally associating the probe vehicle data to lane level cells of the road network;

identifying empty lane level cells of the road network having a non-probe vehicle of the plurality of vehicles where the probe vehicle data is unavailable, wherein the non-probe vehicle is not equipped for computer communication with the probe vehicles;

calculating estimated non-probe vehicle data for the empty lane level cells based on the probe vehicle data using an observer model;

calculating a traffic density value for the road network based on the probe vehicle data and the estimated non-probe vehicle data; and providing the traffic density value to the host vehicle.

2. The computer-implemented method of claim 1, wherein spatially and temporally associating the probe vehicle data to the road network includes generating a grid model representing the road network including a plurality of lanes, and each lane in the plurality of lanes including a plurality of lane level cells, wherein each of the lane level cells of the plurality of lane level cells includes a particular segment of each lane in the plurality of lanes.

3. The computer-implemented method of claim 2, wherein spatially and temporally associating the probe vehicle data to the road network includes integrating the probe vehicle data to a corresponding lane level cell of the plurality of lane level cells.

4. The computer-implemented method of claim 2, wherein identifying the empty lane level cells of the road network where the probe vehicle data is unavailable includes identifying lane level cells of the plurality of lane level cells having an empty value.

5. The computer-implemented method of claim 4, wherein calculating the estimated non-probe vehicle data for the empty lane level cells based on the probe vehicle data includes calculating the estimated non-probe vehicle data for the empty lane level cells based on the probe vehicle data from adjacent lane level cells of the road network.

6. The computer-implemented method of claim 2, further including calculating a traffic flow value and an average speed value for each lane level cell based on the probe vehicle data.

7. The computer-implemented method of claim 6, wherein calculating the estimated non-probe vehicle data for the empty lane level cells based on the probe vehicle data includes calculating an estimated traffic flow value and an estimated average speed value for each of the empty lane level cells based on probe vehicle data from adjacent lane level cells.

8. The computer-implemented method of claim 7, wherein calculating the traffic density value for the road network based on the probe vehicle data and the estimated non-probe vehicle data includes calculating the traffic density value for the road network based on the traffic flow value, the average speed value, the estimated traffic flow value, and the estimated average speed value.

9. The computer-implemented method of claim 1, wherein providing the traffic density value to the host vehicle includes controlling the host vehicle based on the traffic density value.

10. The computer-implemented method of claim 1, wherein providing the traffic density value to the host vehicle includes controlling the host vehicle to display an indication of the traffic density value.

11. A system for traffic state estimation of a road network, comprising:

a host vehicle travelling along the road network equipped for computer communication;

a plurality of vehicles travelling along the road network, the plurality of vehicles including probe vehicles and non-probe vehicles, wherein the probe vehicles are equipped for computer communication; and a processor operatively connected for computer communication to the host vehicle and the probe vehicles, wherein the processor:

receives probe vehicle data from the probe vehicles;

spatially and temporally associates the probe vehicle data at a lane level of the road network;

identifies empty lane level cells of the road network having a non-probe vehicle of the plurality of vehicles where the probe vehicle data is unavailable, wherein the non-probe vehicle is not equipped for computer communication with the probe vehicles;

calculates estimated non-probe vehicle data for the empty lane level cells based on the probe vehicle data using an observer model;

calculates a traffic density value for the road network based on the probe vehicle data and the estimated non-probe vehicle data; and provides the traffic density value to the host vehicle.

12. The system of claim 11, wherein the processor generates a grid model representing the road network including a plurality of lanes, and each lane in the plurality of lanes including a plurality of lane level cells, wherein each of the lane level cells of the plurality of lane level cells includes a particular segment of each lane in the plurality of lanes.

13. The system of claim 12, wherein the processor identifies the empty lane level cells of the road network where the probe vehicle data is unavailable as lane level cells of the plurality of lane level cells having an empty value.

14. The system of claim 13, wherein the processor further calculates a traffic flow value and an average speed value for each non-empty cell based on the probe vehicle data, and calculates an estimated traffic flow value and an estimated average speed value for each of the empty lane level cells based on probe vehicle data from adjacent lane level cells.

15. The system of claim 14, wherein the processor further calculates the traffic density value for the road network based on the traffic flow value, the average speed value, the estimated traffic flow value, and the estimated average speed value.

16. A non-transitory computer-readable storage medium including instructions that when executed by a processor, causes the processor to:

receive probe vehicle data from probe vehicles of a plurality of vehicles within a communication range of a host vehicle travelling along a road network, wherein the probe vehicles are equipped for computer communication with other probe vehicles;

spatially and temporally associate the probe vehicle data to lane level cells of the road network;

identify empty lane level cells of the road network having a non-probe vehicle of the plurality of vehicles having an empty value, wherein the non-probe vehicle is not equipped for computer communication with the probe vehicles;

calculate estimated non-probe vehicle data for the empty lane level cells based on the probe vehicle data using an observer model;

calculate a traffic density value for the road network based on the probe vehicle data and the estimated non-probe vehicle data; and transmit the traffic density value to the host vehicle.

17. The non-transitory computer-readable storage medium of claim 16, further causes the processor to generate a grid model representing the road network including a plurality of lanes, and each lane in the plurality of lanes including a plurality of lane level cells, wherein each of the lane level cells of the plurality of lane level cells includes a particular segment of each lane in the plurality of lanes.

18. The non-transitory computer-readable storage medium of claim 17, further causes the processor to calculate a traffic flow value and an average speed value for each non-empty cell based on the probe vehicle data, and calculate an estimated traffic flow value and an estimated average speed value for each of the empty lane level cells based on probe vehicle data from adjacent lane level cells.

19. The non-transitory computer-readable storage medium of claim 18, further causes the processor to calculate the traffic density value for the road network based on the traffic flow value, the average speed value, the estimated traffic flow value, and the estimated average speed value.

20. The non-transitory computer-readable storage medium of claim 19, further causes the processor to generate a control signal based on the traffic density value and transmit the control signal to the host vehicle thereby controlling the host vehicle to display an indication of the traffic density value.

* * * * *